US008230520B2

(12) United States Patent
Riondato

(10) Patent No.: US 8,230,520 B2
(45) Date of Patent: Jul. 31, 2012

(54) BIB FOR PLAYING SPORT, IN PARTICULAR FOR CYCLING

(75) Inventor: Francesco Riondato, Bassano del Grappa (IT)

(73) Assignee: SELLE SMP s.a.s di M. Schiavon, Casalserugo, (Padova) (IT)

( * ) Notice: Subject to any disclaimer, the term of this patent is extended or adjusted under 35 U.S.C. 154(b) by 135 days.

(21) Appl. No.: 12/451,367

(22) PCT Filed: Jul. 28, 2008

(86) PCT No.: PCT/EP2008/006201
§ 371 (c)(1),
(2), (4) Date: Nov. 9, 2009

(87) PCT Pub. No.: WO2009/021621
PCT Pub. Date: Feb. 19, 2009

(65) Prior Publication Data

US 2010/0071111 A1 Mar. 25, 2010

(30) Foreign Application Priority Data

Aug. 10, 2007 (IT) ..... VI2007A0234

(51) Int. Cl.
*A41D 1/06* (2006.01)

(52) U.S. Cl. ..... 2/79; 2/275; 2/408; 2/78.2; 24/306; 24/436; 24/429

(58) Field of Classification Search ..... 2/234, 227, 2/405, 406, 407, 408, 409, 228, 80, 75, 111, 2/78.1, 78.2, 109, 67, 69.5, 78.4, 79, 275, 2/96, 274; 450/101, 102, 103, 104, 105; 112/475.16, 152, 470.33; 24/436, 429, 434, 24/400, 381, 305
See application file for complete search history.

(56) References Cited

U.S. PATENT DOCUMENTS

| | | | | | |
|---|---|---|---|---|---|
| 1,868,741 | A | * | 7/1932 | Gassel | 2/67 |
| 1,986,792 | A | * | 1/1935 | Calvo | 2/67 |
| 2,155,795 | A | * | 4/1939 | Markin | 2/234 |
| 2,277,068 | A | * | 3/1942 | Bulloch | 2/408 |
| 2,697,227 | A | * | 12/1954 | Prupis et al. | 2/234 |
| 3,023,419 | A | * | 3/1962 | Strahle | 2/80 |
| 3,255,503 | A | * | 6/1966 | Sozzi | 24/387 |

(Continued)

FOREIGN PATENT DOCUMENTS

DE 100 47 550 C1 1/2002

(Continued)

OTHER PUBLICATIONS

Brown, Patty and Rice, Janett, Ready-To-Wear Apparel Analysis, 2001, Prentice-Hall, Inc., Third Edition, p. 222.*

(Continued)

*Primary Examiner* — Khoa Huynh
*Assistant Examiner* — Brieanna Fuller
(74) *Attorney, Agent, or Firm* — Buchnam and Archer

(57) ABSTRACT

A sports bib, in particular for cycling, having a pair of shorts, which can have either short or long legs, extending into a vest, which ends with a pair of straps. The bib is equipped with a zipper at the housing position of the anus and the genital organs. The zipper is provided with characteristics such as to not produce scrapes or rubbing at the genital areas and crotch on the user during movements and in particular while pedalling.

4 Claims, 5 Drawing Sheets

U.S. PATENT DOCUMENTS

| | | | | |
|---|---|---|---|---|
| 3,271,832 | A * | 9/1966 | Yankers | 24/387 |
| 3,276,086 | A * | 10/1966 | Reese | 24/387 |
| 3,718,105 | A * | 2/1973 | Glindmeyer | 112/475.13 |
| 4,166,463 | A * | 9/1979 | Bloom | 602/63 |
| 4,205,397 | A * | 6/1980 | Bechis | 2/67 |
| 4,578,828 | A * | 4/1986 | Smith et al. | 2/234 |
| 4,773,101 | A * | 9/1988 | Kapp et al. | 2/69.5 |
| 4,805,243 | A * | 2/1989 | Gibbens et al. | 2/228 |
| 4,866,789 | A * | 9/1989 | Dorm | 2/462 |
| 5,263,201 | A * | 11/1993 | Hood | 2/234 |
| 5,271,101 | A * | 12/1993 | Speth et al. | 2/228 |
| 5,539,926 | A * | 7/1996 | Mantos | 2/23 |
| 5,713,373 | A * | 2/1998 | Argentino | 128/869 |
| 5,790,984 | A * | 8/1998 | Doubleday | 2/69 |
| 6,049,913 | A | 4/2000 | Harrigan | |
| 6,061,832 | A | 5/2000 | Morrison | |
| 6,237,152 | B1 | 5/2001 | Gootrad | |
| 6,427,493 | B1 * | 8/2002 | Kasdan et al. | 66/169 R |
| 6,460,186 | B1 * | 10/2002 | Dailly | 2/109 |
| 6,473,910 | B2 * | 11/2002 | Creagan et al. | 2/458 |
| 6,971,935 | B1 * | 12/2005 | Gilmer | 441/106 |
| 6,981,282 | B2 * | 1/2006 | Marty et al. | 2/69 |
| 7,305,717 | B1 * | 12/2007 | Brown | 2/114 |
| 7,386,893 | B2 * | 6/2008 | Chang | 2/96 |
| 2003/0056282 | A1 * | 3/2003 | Coccia | 2/466 |
| 2005/0223478 | A1 * | 10/2005 | Hogan | 2/466 |
| 2007/0226869 | A1 * | 10/2007 | Maier | 2/69 |

FOREIGN PATENT DOCUMENTS

| | | | |
|---|---|---|---|
| GB | 2 127 276 | A | 4/1984 |
| JP | 2002-253308 | A * | 9/2002 |

OTHER PUBLICATIONS

The Editors of Cowles Creative Publishing in cooperation with the Sewing Education Dept., Singer Sewing Company, SingerSewing Reference Library-Clothing Care and Repair, 1985, Cy Decosse, Inc., p. 63.*

Ansun Multitech (India) Ltd., Product—http://www.ansun.com/faq-products.html.*

The Triathlete Store.com, Shop-Swim, Bike, Run., www.thetriathletestore.com.*

International Search Report.

* cited by examiner

BIB FOR PLAYING SPORT, IN PARTICULAR FOR CYCLING

CROSS REFERENCE TO RELATED APPLICATIONS

This application is the National Stage of PCT/EP2008/006201 filed on Jul. 28, 2008, which claims priority under 35 U.S.C. §119 of Italian Application No. VI2007A000234 filed on Aug. 10, 2007, the subject matter of which is herein incorporated by reference. The international application under PCT article 21(2) was published in English.

DESCRIPTION

The present finding concerns a bib for playing sport, in particular for cycling, according to the general part of claim 1.

As known, even though cycling requires a lot of effort and dedication, the numbers of both competitive and recreational cyclists has risen over the last few years. In particular there are many people who use bicycles recreationally for a few hours in their free time. Even in this situation the user tends to use the same sport-wear items used by competitive cyclists, since these give a better performance to those who wish to practice this sport. In particular, for some time the use of bibs equipped with shorts has been wide spread, which in most cases are of limited length, but sometimes are also of the long type, made out of synthetic elastic fabrics.

These sport-wear items are practical to use, as well as having pleasant designs, but they have the considerable drawback which is that it is clearly more difficult for the athlete to empty the urinary bladder and, even more so for the bowels, compared to the same functions wearing normal shorts.

In practice these bibs are mainly used when the user, either competitive, or recreational, rides the bicycle for relatively short periods of time, who normally do not need to void faeces from the bowels or urine from the bladder or when the user (mainly in the recreational field) can interrupt the activity without worrying about the competitive result.

To satisfy the physiological needs of urination and defecation of the people that wear long or short legged shorts, shorts have been conceived in which either a central zipper made out of metallic material or an adherent fly at the crotch and/or at the genital regions is foreseen. For this purpose the documents U.S. Pat. No. 4,578,828 and U.S. Pat. No. 6,061,832 can be cited.

These types of clothing items are not suitable however to use for athletes and in general for cyclists, since that these zippers easily cause irritating and painful abrasions in the crotch and in the genital areas, due to the multiple alternated movements of the lower limbs of athletes and in particular of cyclists. This can cause slowing down or it can jeopardize the action of the athlete during training or, even worse, also during competitive races.

In practice, it is precisely to overcome these drawbacks that currently bibs without any central or side zip are commercialized and sold on the market; these bibs are very beautiful and also very practical, since they are perfectly tight-fitting on to the human body during all the complex and fast movements carried out by the athletes, but they have the great drawback of not allowing an easy evacuation of the athlete's bladder and anus.

In order to fully understand the need of having a comfortable and practical garment able to make the athlete's activity easier, in particular in the case of a competitive cyclist, it is useful to bear in mind that such athlete will pedal, in an intense practice session or in a competitive race around 70/100 times a minute, which therefore means that in a normal 6 hour cycling race (but there are also races that last 7-8 hours!) the athlete pedals around 25'000/36'000 times. It is clear that the skin of the athlete in the crotch area and in the genital regions undergoes a high amount of rubbing of the shorts during this movement of the lower limbs. This is why there is the need to have a comfortable and reliable garment available, in particular at the aforementioned areas.

The purpose of the present finding is that of making a sport bib, in particular for cycling, that does not have the substantial aforementioned drawbacks. In particular said bib must be easy from the making point of view and must not be complicated to wear compared to the other known similar garments.

This is obtained, according to the finding, by foreseeing the presence of a zipper at the crotch and/or genital areas; at the inner part of the bib, the fabric is sewn on to each of the two strips of tape to which one set of zipper teeth is fastened so that it is as close as possible to the teeth themselves, ensuring that the thickness of the zipper is substantially equal to that globally taken by the areas of the bib in proximity of the zipper; moreover neither the inner side, nor the outer side of the zipper are covered by any portion of the fabric of the bib.

In this way the presence of the zipper does not create any "bulging" of the bib, at the crotch or genital areas; tests carried out have allowed to testify that, thanks to this provision, there is no more "rubbing" nor scraping at the crotch and genital areas of the user, with obvious advantages for the cyclist.

Further characteristics of the finding are described in the dependent claims.

These and other characteristics of the finding shall now be described in detail in the following, with reference to some of its particular embodiments, given as an example and not for limiting purposes, with the aid of the attached tables of drawings, where:

Figure 1:
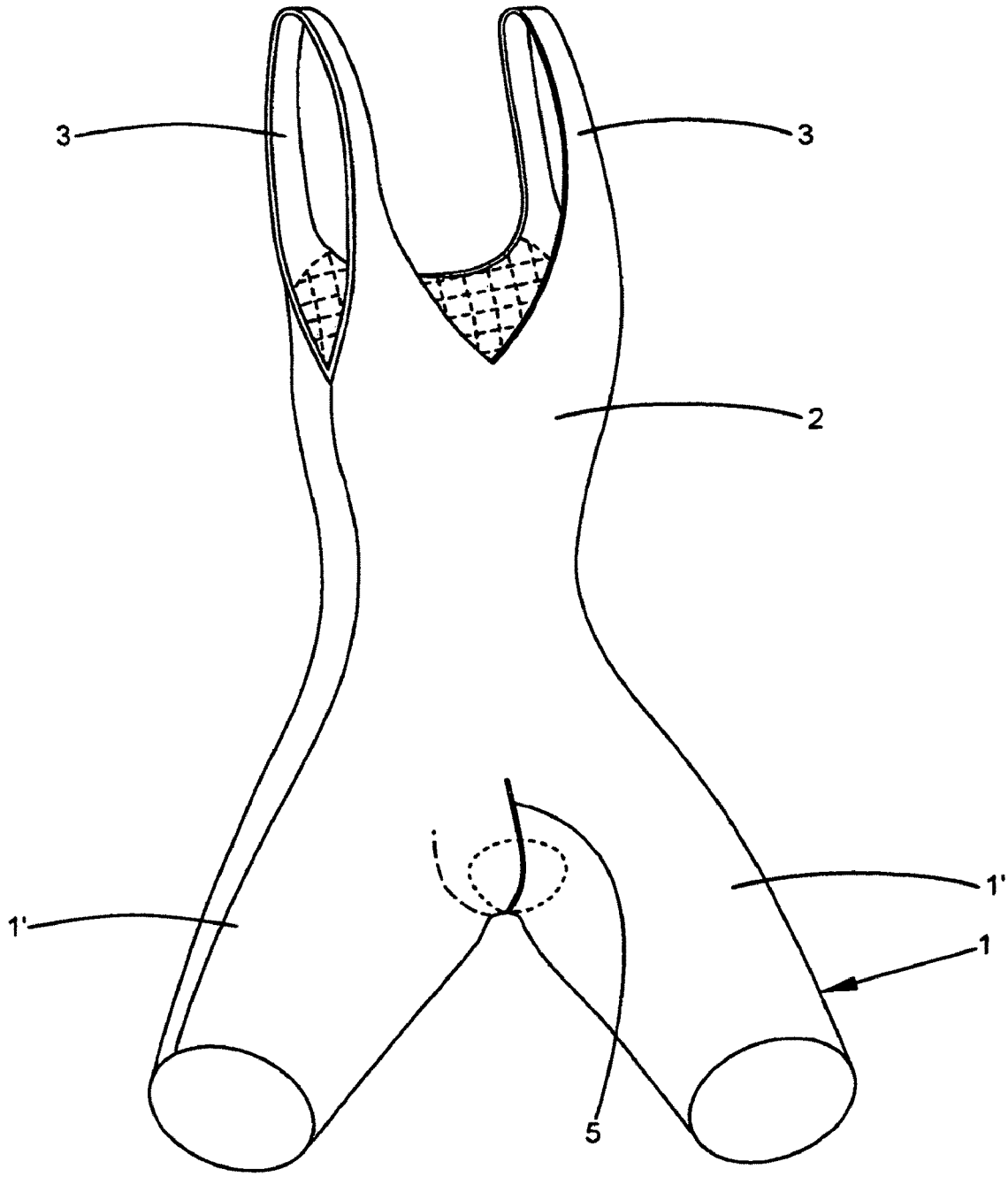
FIG. 1 (tab. I) represents a perspective view of an embodiment of the bib made according to the finding.
Figure 2:
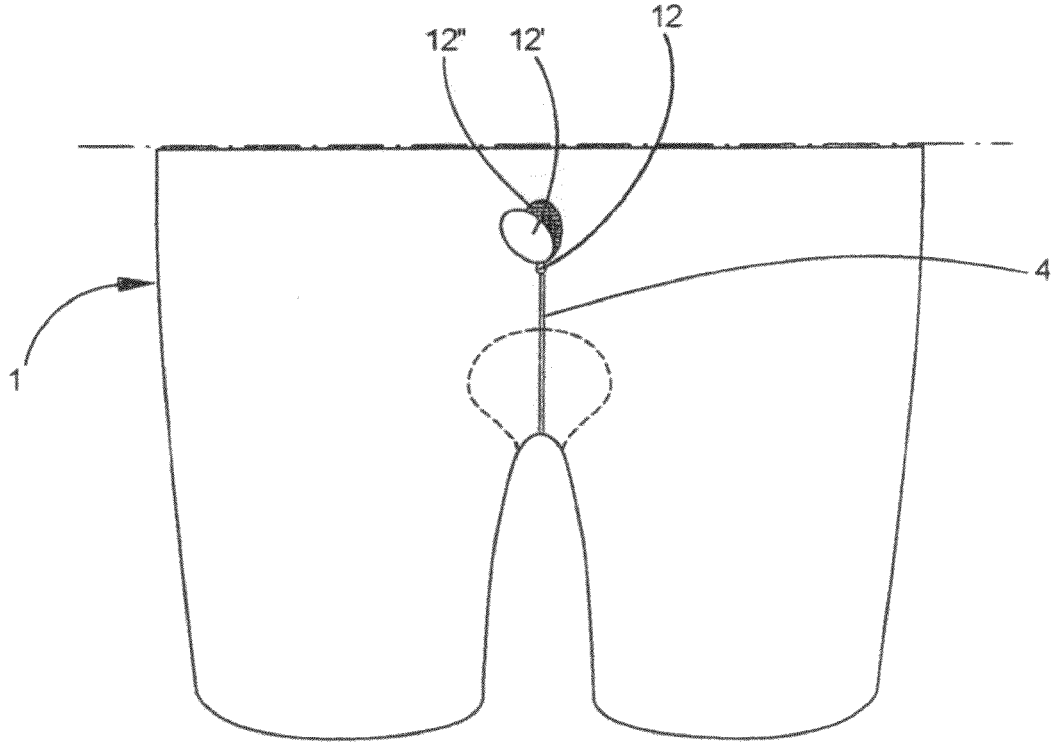
FIG. 2 (tab. II) represents a front view of the lower portion of the aforementioned.

In FIG. 1 it is possible to see that the device of the finding consists of a bib which has, as per usual, a vest 2, with a pair of straps 3 and shorts 1. Regarding this, it should be specified that instead of the short legged shorts illustrated, also a pair of long legged shorts may be foreseen, without for this reason departing from the scope of the finding. This bib, according to already known ways, will be made in Lycra, polyester or other types of synthetic or natural fabrics of the kind normally used for making other similar known garments. At the joining point of the two legs 1' of the shorts 1, at the anus and genital housing areas, there is a zipper 5 which, as per usual, has two sets of teeth 5', 5" (FIG. 3) intended to engage/disengage one another according to movements of a slider 12 (FIG. 2) manually actuated by the user.

Advantageously said zip shall be of the kind known as "3" that is highly tenacious and with "a spiral rack", made out of a plastic material, in particular nylon®.

Figure 3:
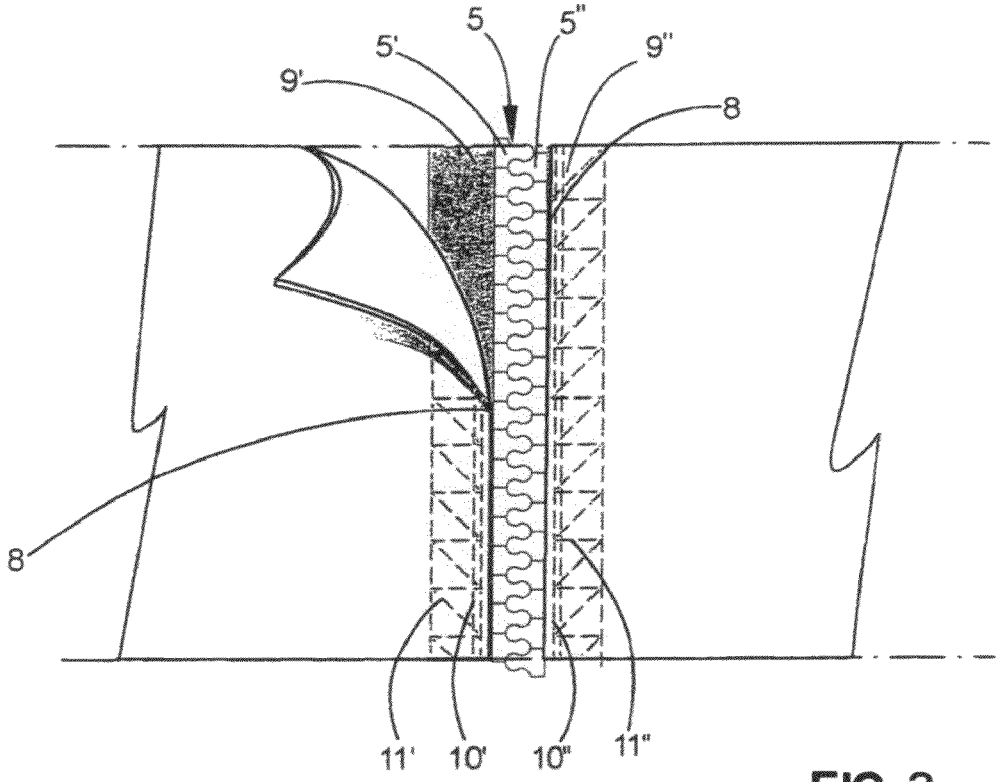
FIG. 3 represents a detail of the zipper and of the surrounding areas present in the device according to the finding.

By carefully observing FIG. 3, it can be seen that the fastening of the strips of tape 9', 9", fixedly connected to the teeth 5', 5" of the zipper 5 is made through a first set of stitches 10', 10" sewn at the area of the strips of tape 9', 9" placed near the teeth 5', 5"; moreover another set of zigzag stitches 11', 11" are sewn on with the fabric 8 at the remaining part of the strip of tape. In this way the tactile function of the skin is given mechanical simulation, equivalent to a homogeneous surface of fabric. Moreover, as can be seen in particular in FIG. 2, since the zipper is not covered by any portion of the fabric, only the cutting line 4 of the same fabric is visible when it is closed. Thank to these provisions the user does not practically "notice" the presence of the zipper and does not suffer from scraping or rubbing at the genital and crotch areas related movement of the lower limbs. As visible if FIG. 2 the slider 12 of the zipper can be advantageously equipped with a small fly 12' that, at one of its surfaces is covered by a layer of male or female type VELCRO (hook and loop), suitable for adhering to a corresponding surface 12" covered in female-male type VELCRO (hook and loop) fastened on the shorts 1 of the bib, immediately above the upper end of the zipper 5, determining the reversible adhesion of the fly and therefore, in summary, the locking of the slider, i.e., stopping the zipper from accidentally and undesirably opening; moreover the presence of the fly 12' makes it more comfortable for the cyclist athlete to open the zipper.

Figure 4:
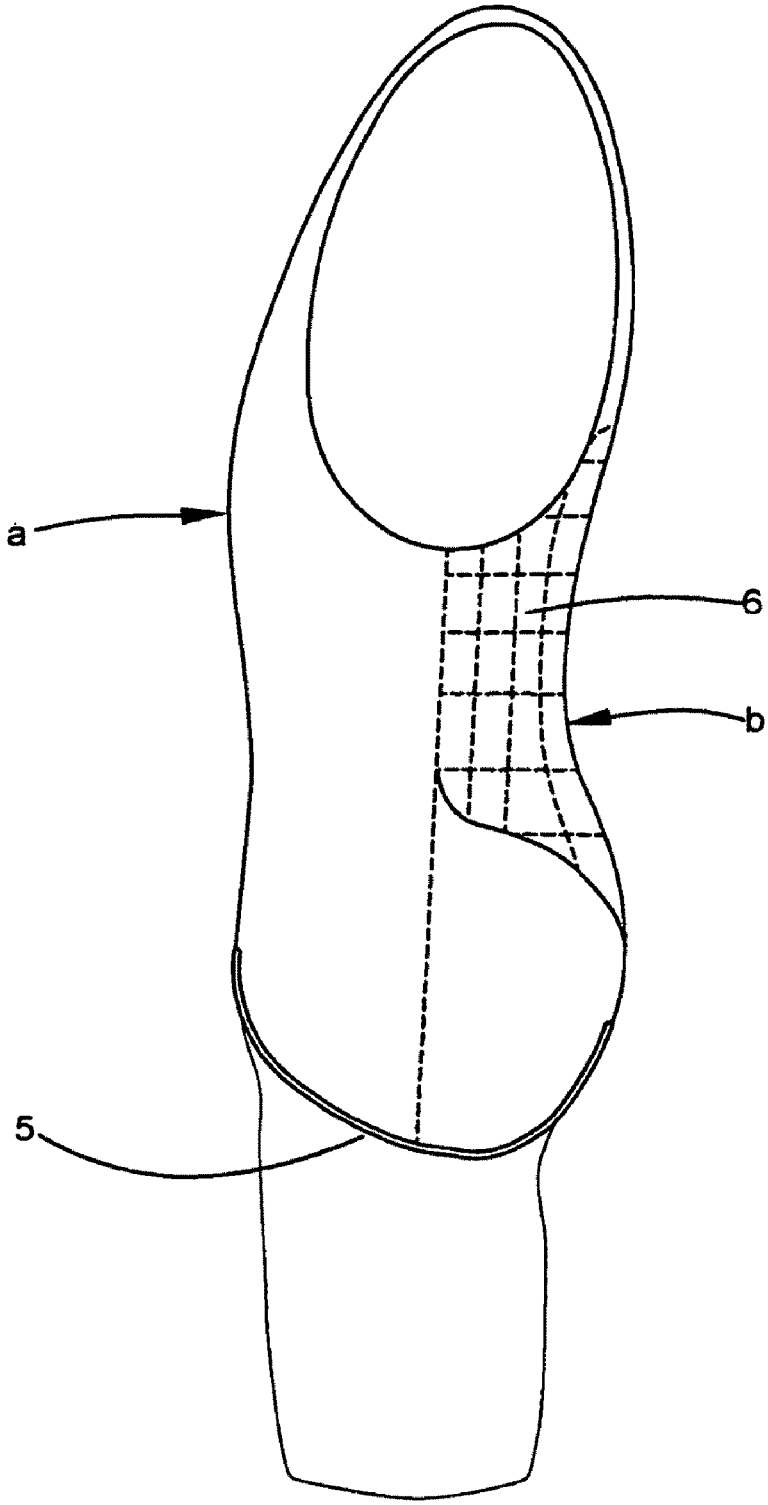
FIG. 4 (tab. III) represents a vertical section of the bib according to the finding.
Figure 5:
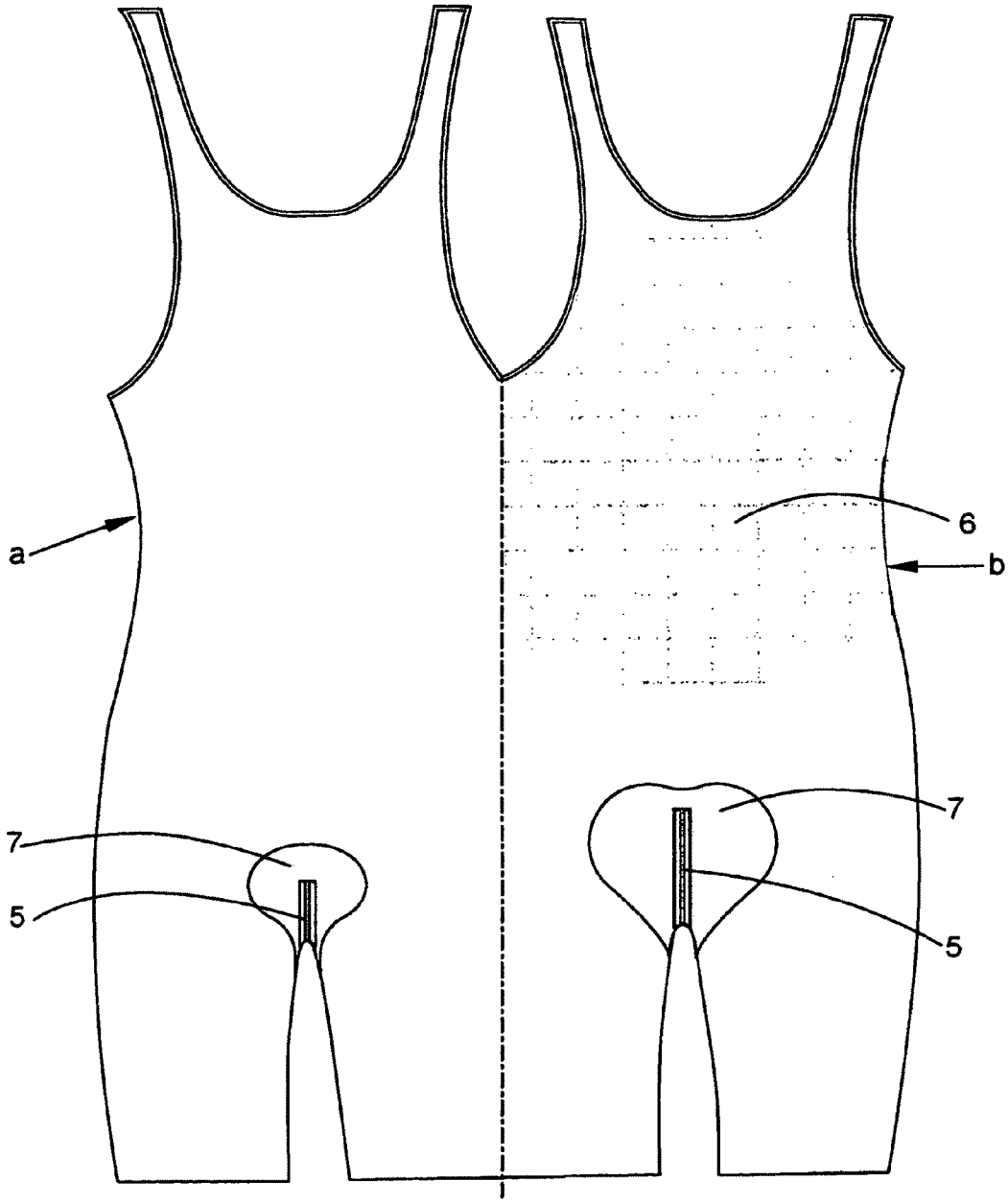
FIG. 5 (tab. IV) represents the inner part of the bib "opened up".
Figure 6:
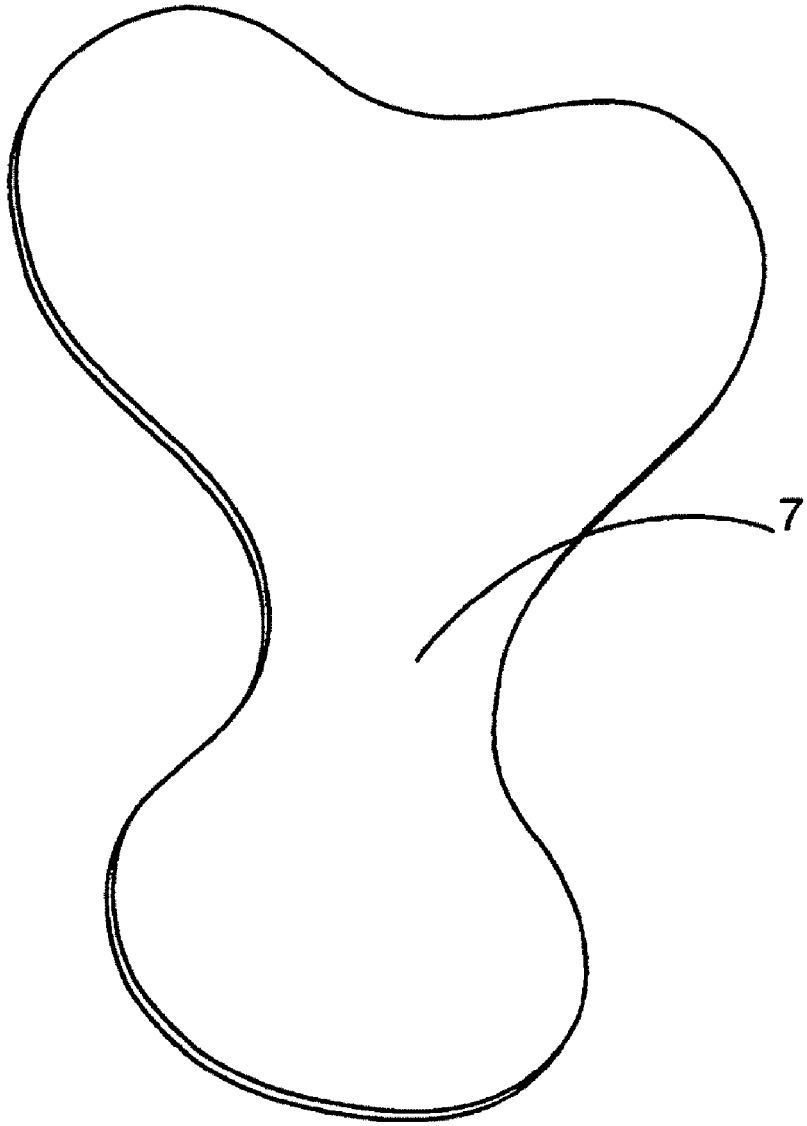
FIG. 6 (tab. V) represents an overall view of the underpad that can be applied onto the shorts of the bib according to the finding.

As visible in FIGS. 4 and 5 the zipper 5 advantageously begins at about 3-4 cm above the position of the penis (or of the vagina in case the athlete is female) and ends at the upper joining point of the buttocks. At the area in which there is the zipper an underpad 7, is advantageously applied, providing the user with further and better protection of the skin at the crotch and genital area, which is useful when pedalling for many hours. In particular this underpad is clearly visible in FIG. 6.

Finally, as shown in FIGS. 4 and 5, the bib 1 is provided with a front part a and a rear part b and at the inner surface of the rear part b of the bib there is advantageously a layer 6 of fabric made out of synthetic fibre, advantageously polypropylene, fixed onto the fabric of the bib through micro-stitching; the presence of this fabric is able to stop water from being absorbed, which is very useful particularly in the case of rain, as well as the keep the body temperature of the athlete substantially unchanged. Moreover this material of polypropylene allows the evaporation of sweat from the skin without stagnating an it also has the substantial property of being able to dry rapidly.

From all of the above it is possible to see how the device according to the finding allows athletes to carry out their physiological needs, in particular when they have to urinate and defecate, all of which can be done without taking off the garment. This is very important and advantageous for the competitive cyclist, but also for the recreational cyclists when participating in competitive races because, once subject to ones physiological stimulations, with the help of two friends and moving towards the side of the track, it is possible to urinate or defecate easily keeping in this way one's own previous position in the race. Moreover even female athletes can carry out these physiological functions without needing to take off the bib which could turn out to be even more annoying and indecent, since they would have to reveal their breasts.

At the same time the solutions previously foreseen at the zipper, enable the user to not even notice its presence and will not suffer practically any scraping or rubbing during the activity.

Finally the presence of the material in polypropylene at the back of the bib protects the athlete from pains occurring at the joints, at the lumbar area and vertebras all of which are typical ailments caused by cycling in bad weather.

The invention claimed is:

1. A bib for sports, particularly for cycling, made out of fabric (8) which includes a vest (2) provided at a top part thereof with a pair of straps (3) and at a bottom part thereof with a pair of shorts (1) having a pair of leg portions (1'), said bib comprises at a joining point of the pair of leg portions (1') housing an anus and genitals of a wearer a zipper (5), said zipper (5) includes strips of tape (9', 9") fixedly connected to respective strips of teeth (5', 5"), said strips of tape (9', 9") being sewn into the fabric (8) of the pair of shorts (1) through a first stitching (10', 10") adjacent to each said respective strips of teeth (5', 5") and a second zigzag shaped stitching (11', 11") respectively covering an entire width of each said strips of tape (9', 9"); wherein the fabric (8) of said bib surrounding the zipper (5) is sewn respectively to each said strips of tape (9', 9") as close as possible to said respective strips of teeth (5', 5") so that an entire thickness of the zipper (5) is substantially equal to a thickness of the fabric (8) surrounding the zipper (5), and wherein said respective strips of teeth (5', 5") of the zipper (5) in a closed position are not covered by any portion of the fabric (8) surrounding said zipper (5) on an inner surface and outer surface of said bib so that when the zipper (5) is closed only an external view of said respective strips of teeth (5', 5") are visible, said zipper (5) includes a slider (12) for operating the zipper having a fly (12') attached to the slider (12), said fly (12') is defined by said slider having on one of its faces a hook and loop type fastening element adapted for fastening, wherein in a closed position of the zipper (5), said fly is adapted to fasten onto a corresponding surface (12") having a hook and loop type fastening element, said corresponding surface (12") being fastened on said pair of shorts (1) immediately above an upper end of the zipper (5) so as to lock said zipper (5) in a closed position.

2. The bib for sports according to claim 1, wherein said zipper (5) is a type 3, highly tenacious with a spiral rack and formed of plastic material.

3. The bib for sports according to claim 1, which further includes an underpad (7) on the inner surface of said bib in an area where the zipper (5) is located.

4. The bib for sports according to claim 1, which further includes on the inner surface of a back (b) of said bib a portion of fabric (6) formed of polypropylene.

* * * * *